US011725815B2

(12) United States Patent
Jacob et al.

(10) Patent No.: US 11,725,815 B2
(45) Date of Patent: Aug. 15, 2023

(54) APPARATUSES, SYSTEMS, AND METHODS FOR OPTIMIZING ACOUSTIC WAVE CONFINEMENT TO INCREASE COMBUSTION EFFICIENCY

(71) Applicant: GTL Company, Tullahoma, TN (US)

(72) Inventors: Eric Jacob, Tullahoma, TN (US); Joshua Batterson, Manchester, TN (US); Justin Guastaferro, Murfreesboro, TN (US); Paul Gloyer, Tullahoma, TN (US)

(73) Assignee: GTL COMPANY, Tullahoma, TN (US)

( * ) Notice: Subject to any disclaimer, the term of this patent is extended or adjusted under 35 U.S.C. 154(b) by 208 days.

(21) Appl. No.: 17/114,131

(22) Filed: Dec. 7, 2020

(65) Prior Publication Data

US 2021/0317789 A1 Oct. 14, 2021

Related U.S. Application Data

(60) Provisional application No. 62/944,965, filed on Dec. 6, 2019.

(51) Int. Cl.
*F23R 3/00* (2006.01)
*F23R 3/34* (2006.01)

(52) U.S. Cl.
CPC ..... *F23R 3/002* (2013.01); *F23R 3/34* (2013.01); *F23R 2900/00015* (2013.01)

(58) Field of Classification Search
CPC .. F23R 3/002; F23R 3/34; F23R 2900/00014; F23R 2900/00015; F23R 3/44; F23R 3/52; F23R 3/42
See application file for complete search history.

(56) References Cited

U.S. PATENT DOCUMENTS 6,412,282 B1 * 7/2002 Willis ..... F23R 3/346 60/737
2006/0207259 A1 * 9/2006 Holt ..... F23M 20/005 60/725

OTHER PUBLICATIONS

Clayton, et al., An Experimental Description of Destructive Liquid Rocket Resonant Combustion, AIAA Journal, Jul. 1968, pp. 1252-1259, vol. 6, No. 7.
Hargus, et al., Air Force Research Laboratory Rotating Detonation Rocket Engine Development, AIAA Propulsion and Energy Forum, Jul. 9-11, 2018, pp. 1-25, Cincinnati, Ohio.
Oefelein, et al., Comprehensive Review of Liquid-Propellant Combustion Instabilities in F-I Engines, Journal of Propulsion and Power, Sep.-Oct. 1993, pp. 657-677, vol. 9, No. 5.

* cited by examiner

*Primary Examiner* — Katheryn A Malatek
(74) *Attorney, Agent, or Firm* — Kunzler Bean & Adamson

(57) ABSTRACT

Disclosed herein is an apparatus. The apparatus comprises an injector coupled to a head portion of a combustion chamber, the injector comprising a plurality of injector elements distributed away from an inner annulus and in an outer annulus. A geometry of combustion chamber comprises a body portion, an optional shoulder portion, and a throat portion. An inner wall of combustion chamber converges radially inward towards the throat. The plurality of injector elements in combination with the geometry of the combustion chamber are configured to confine a predetermined percentage of mass flow associated with combustion to a predetermined outer annulus of the chamber.

19 Claims, 10 Drawing Sheets

APPARATUSES, SYSTEMS, AND METHODS FOR OPTIMIZING ACOUSTIC WAVE CONFINEMENT TO INCREASE COMBUSTION EFFICIENCY

CROSS-REFERENCES TO RELATED APPLICATIONS

This application claims the benefit of U.S. provisional application No. 62/944,965 filed on Dec. 6, 2019, the entire contents of which are incorporated herein by reference for all purposes.

FIELD

This disclosure relates to combustion chambers and more particularly relates to apparatuses, systems, and methods for optimizing acoustic wave confinement to increase combustion efficiency.

BACKGROUND

Combustion chambers for rocket engines, generators, and other applications use various designs for bringing liquid fuel and oxidizer into the chamber for mixing and combustion. In some rocket engine designs, fuel is injected radially. For example, some rotating detonation engine ("RDE") designs use radial injection. Other RDE designs use axial injection. Some air-breathing rocket engines/chambers also bring in fuel and/or air radially. Various combustion chamber geometries may be used to adjust stability and performance parameters.

SUMMARY

An apparatus for optimizing acoustic wave confinement to increase combustion efficiency is disclosed.

Disclosed herein is an apparatus. The apparatus comprises an injector coupled to a head portion of a combustion chamber, the injector comprising a plurality of injector elements distributed away from an inner annulus and in an outer annulus. A geometry of combustion chamber comprises a body portion, an optional shoulder portion, and a throat portion. An inner wall of combustion chamber converges radially inward towards the throat. The plurality of injector elements in combination with the geometry of the combustion chamber are configured to confine a predetermined percentage of mass flow associated with combustion to a predetermined outer annulus of the chamber. The preceding subject matter of this paragraph characterizes example 1 of the present disclosure.

The body portion of the geometry of the combustion chamber is substantially cylindrical and the shoulder portion converges radially inward to the throat portion in the downstream direction. The preceding subject matter of this paragraph characterizes example 2 of the present disclosure, wherein example 2 also includes the subject matter according to example 1, above.

Along a longitudinal centerline axis, the ratios of the length of the body portion to the shoulder portion to the throat portion are about 8:3:2. The preceding subject matter of this paragraph characterizes example 3 of the present disclosure, wherein example 3 also includes the subject matter according to example 2, above.

The body portion of the geometry of the combustion chamber has that converges radially inward to the throat portion downstream. The preceding subject matter of this paragraph characterizes example 4 of the present disclosure, wherein example 4 also includes the subject matter according to any one of examples 1-3, above.

Ratio of the length of the body portion along a longitudinal centerline axis to the ratio of the throat portion is at least 8:1. The preceding subject matter of this paragraph characterizes example 5 of the present disclosure, wherein example 5 also includes the subject matter according to any one of examples 2-4, above.

The apparatus further comprises a centerbody disposed radially inward from the injector elements in the outer annulus, the centerbody configured to limit crosswise acoustic wave interference and to direct the mass flow of the combustion to the predetermined outer annulus of the chamber. The preceding subject matter of this paragraph characterizes example 6 of the present disclosure, wherein example 6 also includes the subject matter according to any one of examples 1-5, above.

The centerbody is selected from a single resonator cavity disposed along the longitudinal centerline and a plurality of resonators arranged around the longitudinal centerline. The preceding subject matter of this paragraph characterizes example 7 of the present disclosure, wherein example 7 also includes the subject matter according to example 6, above.

The outer annulus comprises the outer 50% of the radius from the longitudinal centerline to the inner wall of the head portion of the combustion chamber and wherein greater than 75% of the mass flow associated with the combustion is confined to the outer annulus. The preceding subject matter of this paragraph characterizes example 8 of the present disclosure, wherein example 8 also includes the subject matter according to any one of examples 2-7, above.

The outer annulus comprises the outer 40% of the radius from the longitudinal centerline to the inner wall of the head portion of the combustion chamber and wherein greater than 64% of the mass flow associated with the combustion is confined to the outer annulus. The preceding subject matter of this paragraph characterizes example 9 of the present disclosure, wherein example 9 also includes the subject matter according to any one of examples 2-8, above.

The outer annulus comprises the outer 30% of the radius from the longitudinal centerline to the inner wall of the head portion of the combustion chamber and wherein greater than 51% of the mass flow associated with the combustion is confined to the outer annulus. The preceding subject matter of this paragraph characterizes example 10 of the present disclosure, wherein example 10 also includes the subject matter according to any one of examples 2-9, above.

The outer annulus comprises the outer 20% of the radius from the longitudinal centerline to the inner wall of the head portion of the combustion chamber and wherein greater than 36% of the mass flow associated with the combustion is confined to the outer annulus. The preceding subject matter of this paragraph characterizes example 11 of the present disclosure, wherein example 11 also includes the subject matter according to any one of examples 2-10, above.

The outer annulus comprises the outer 10% of the radius from the longitudinal centerline to the inner wall of the head portion of the combustion chamber and wherein greater than 19% of the mass flow associated with the combustion is confined to the outer annulus. The preceding subject matter of this paragraph characterizes example 12 of the present disclosure, wherein example 12 also includes the subject matter according to any one of examples 2-11, above.

The injector comprises an exaggerate radial injector ring wherein at least a portion of the combustion chamber extends upstream of the injector, the upstream extending portion configured to drive combustion upstream. The preceding subject matter of this paragraph characterizes example 13 of the present disclosure, wherein example 13 also includes the subject matter according to any one of examples 2-12, above.

The injector has an semi-toroidal shape wherein a first portion of the plurality of injector elements is distributed along an upstream faces of the semi-toroidal shape and serve as generally axial injectors and a second portion of the plurality of injector elements is distributed along a radial side curve of the semi-toroidal shape. The preceding subject matter of this paragraph characterizes example 14 of the present disclosure, wherein example 14 also includes the subject matter according to any one of examples 2-13, above.

The injector elements comprise one or more oxidizer injector ports and one or more fuel injector ports, configured to inject a plurality of propellants respectively comprising at least one oxidizer and at least one fuel. The preceding subject matter of this paragraph characterizes example 15 of the present disclosure, wherein example 15 also includes the subject matter according to any one of examples 2-14, above.

The propellants have a form selected from a gaseous form, a liquid form, a gel form, and a hybrid form. The preceding subject matter of this paragraph characterizes example 16 of the present disclosure, wherein example 16 also includes the subject matter according to example 15, above.

The injector elements are selected from doublet, coaxial, triplets, split triplets, pentads, and combinations thereof. The preceding subject matter of this paragraph characterizes example 17 of the present disclosure, wherein example 17 also includes the subject matter according to any one of examples 15-16, above.

Further disclosed herein is system. The system comprises an apparatus selected from a rocket engine, an air breathing combustion engine, a gas generator, a preburner, and a power generator. The apparatus comprises a combustion chamber having an injector coupled to a head portion of a combustion chamber, the injector comprising a plurality of injector elements distributed away from an inner annulus and in an outer annulus. A geometry of combustion chamber comprises a body portion, an optional shoulder portion, and a throat. An inner wall of combustion chamber converges radially inward towards the throat. The plurality of injector elements in combination with the geometry of the combustion chamber are configured to confine a predetermined percentage of the mass flow associated with combustion to a predetermined outer annulus of the chamber. The preceding subject matter of this paragraph characterizes example 18 of the present disclosure.

The system further comprises one or more nozzles coupled to the throat portion of the combustion chamber. The preceding subject matter of this paragraph characterizes example 19 of the present disclosure, wherein example 19 also includes the subject matter according to example 18, above.

Additionally, disclosed herein is a method for increasing combustion efficiency. The method comprises determining a geometry for the combustion chamber to increase coupling between unsteady acoustic wave and combustion. The method also comprises determining injection configuration parameters for a combustion chamber the injection configuration parameters selected from propellant type, number of fuel injector ports, number of injector ports per injector element, direction of injector ports, placement of the injector elements within an outer radius mass flow range, and combinations thereof. The method further comprises configuring one or more limiting devices to reduce unwanted acoustic modes. The preceding subject matter of this paragraph characterizes example 20 of the present disclosure.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter and are not, therefore, to be considered to be limiting of its scope, the subject matter will be described and explained with additional specificity and detail through the use of the drawings, in which.

DETAILED DESCRIPTION

Figure 1A:
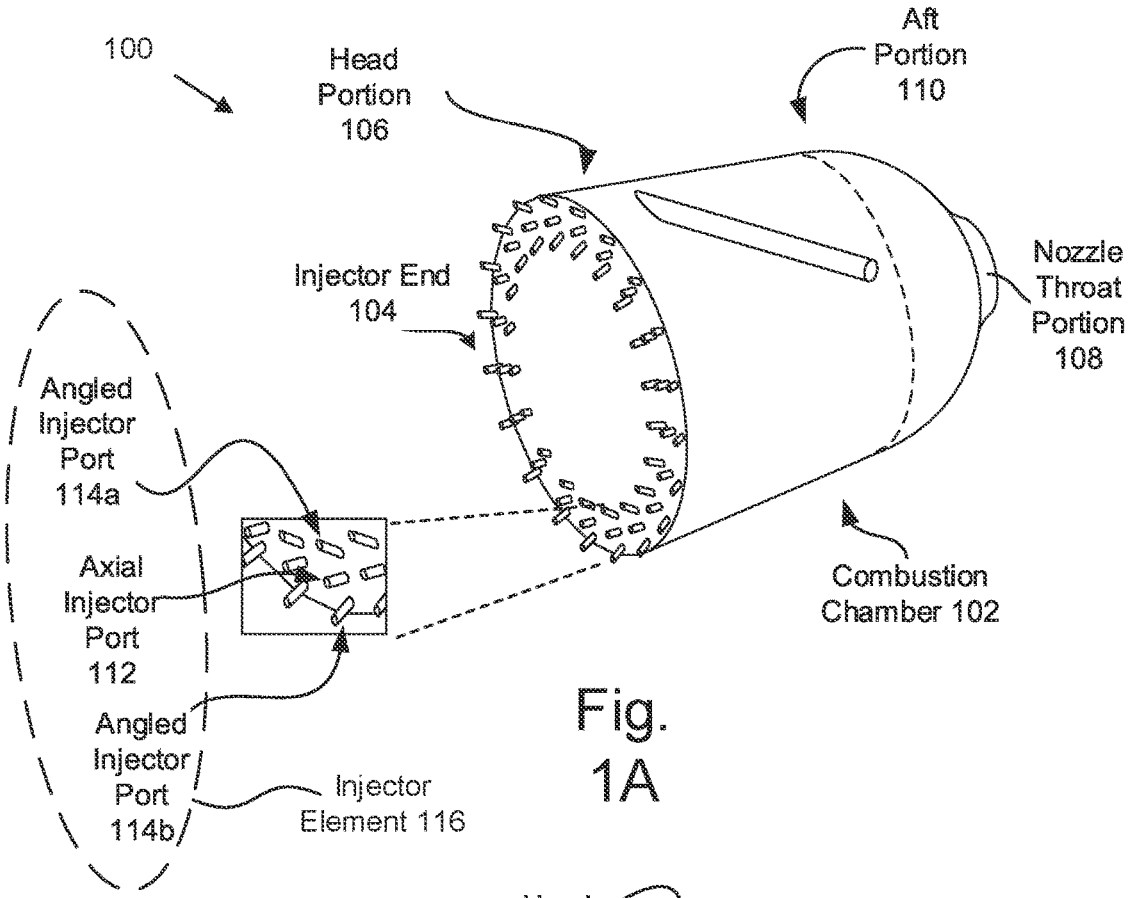
FIG. 1A is a perspective view of a first implementation of an apparatus having a flowpath for optimizing acoustic wave confinement to increase combustion efficiency in a chamber having a converging bottle-shaped geometry and axial injection, according to one or more examples of the present disclosure.

The subject matter of the present application has been developed in response to the present state of the art, and in particular, in response to the problems and needs that have not yet been fully solved by currently available rocket engines and design techniques. The subject matter of the present application has been developed to provide a unique and useful protection that overcomes at least some of the shortcomings of prior art techniques Reference throughout this specification to features, advantages, or similar language does not imply that all of the features and advantages that may be realized with the subject matter of the present disclosure should be or are in any single embodiment of the subject matter. Rather, language referring to the features and advantages is understood to mean that a specific feature, advantage, or characteristic described in connection with an embodiment is included in at least one embodiment of the subject matter of the present disclosure. Thus, discussion of the features and advantages, and similar language, throughout this specification may, but do not necessarily, refer to the same embodiment.

Furthermore, the described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain examples and/or implementations that may not be present in all examples or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims or may be learned by the practice of the subject matter as set forth hereinafter.

Similarly, reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more examples of the subject matter of the present disclosure, however, absent an express correlation to indicate otherwise, an implementation may be associated with one or more examples.

Combustion systems that rely on deflagration burning may have reached a level of maturity where dramatic increases in performance are difficult to achieve. On the other hand, high-amplitude acoustic waves, brought about by combustion instability (CI), may be used to increase combustion efficiency. Increased efficiency may lead to increased performance, smaller form factors, or both. Combustion instability, or acoustic instability, is a phenomenon where high-amplitude acoustic waves form in energetic flow fields. These waves form when the rate of energy transferred into an acoustic wave (driving) is greater than the rate of energy dissipated (damping).

Many physical mechanisms contribute to acoustic driving and damping. One prevalent mechanism is energy released due to chemical combustion. When combustion processes respond in concert with acoustic oscillations, self-excited acoustic driving can occur. Unlike deflagration, which produces mostly heat, and subsequently produces pressure, devices experiencing high-amplitude waves can result in increased pressure, temperature, and exhaust velocity through a constant-volume process. In some cases, high-amplitude acoustic waves have been described as "detonation-like" and exhibit wave properties like those found in rotating detonation engines which can achieve an ideal thermodynamic efficiency improvement of approximately 10% over normal deflagrating, constant-pressure combustion devices.

combustors can be designed to control the preferential location of acoustic modes. This process of "mode-shaping" is useful for deflagrating combustors to minimize or eliminate combustion instabilities by decoupling acoustic modes from their sources of driving. However, co-locating the maximum acoustic amplitude with the location of combustion can have the opposite effect by reinforcing acoustic driving, thereby producing the performance benefits associated with combustion instabilities, for example, in pressure gain combustion devices such as detonation engines.

Described herein are various implementations of an apparatus for pressure gain combustion, also sometimes referred to herein as a pressure gain combustor, whose design promotes the formation of high-amplitude waves in a combustion chamber. In some examples, improvements in combustion efficiency may be facilitated by pressure gain, improvements in mixing, and so forth. Thus, various examples of the apparatuses described herein may be referred to as pressure gain combustors.

Moreover, as used herein, the terms "pressure gain combustor" or "apparatus for pressure gain combustion" should not be interpreted as limiting the improvements in combustion efficiency to those brought about by pressure gain. For example, the mixing of injected oxidizer and fuel may be improved because of the interaction of the propellant streams with an acoustic wave.

The chamber geometries disclosed provide examples of designs that maximize pressure gain and optimize mixing and can be used with radial, axial, and angled injecting elements. Additionally, the placement of injectors within the various wave-optimizing chamber geometries disclosed herein, such as for example, radial injection along a curved surface, may further enhance improvements in combustion efficiency.

Although certain rotating detonation engine (RDE) type combustion chambers may use radial or axial injection, the chamber geometries disclosed herein may be used to improve combustion efficiency with or without detonation. Likewise, although air-breathing combustion chambers may also bring fuel or air in radially, the various examples disclosed herein allow various types of injection to be used in conjunction with inventive chamber geometries that improve efficiency (e.g. through improvements in pressure gain and/or mixing).

The various examples described herein purposefully use combustion instability to drive high amplitude waves. In such examples, the disclosed combustion chamber geometries confine acoustic modes to injection regions and combustion zones to reinforce acoustic driving to promote corresponding increases in efficiency and performance. Such wave-optimizing chamber geometries and injector placements within the chamber geometries can be implemented in combination with varying angles of injection to increase efficient upstream mixing at the injector end of the combustion chamber.

Figure 1B:
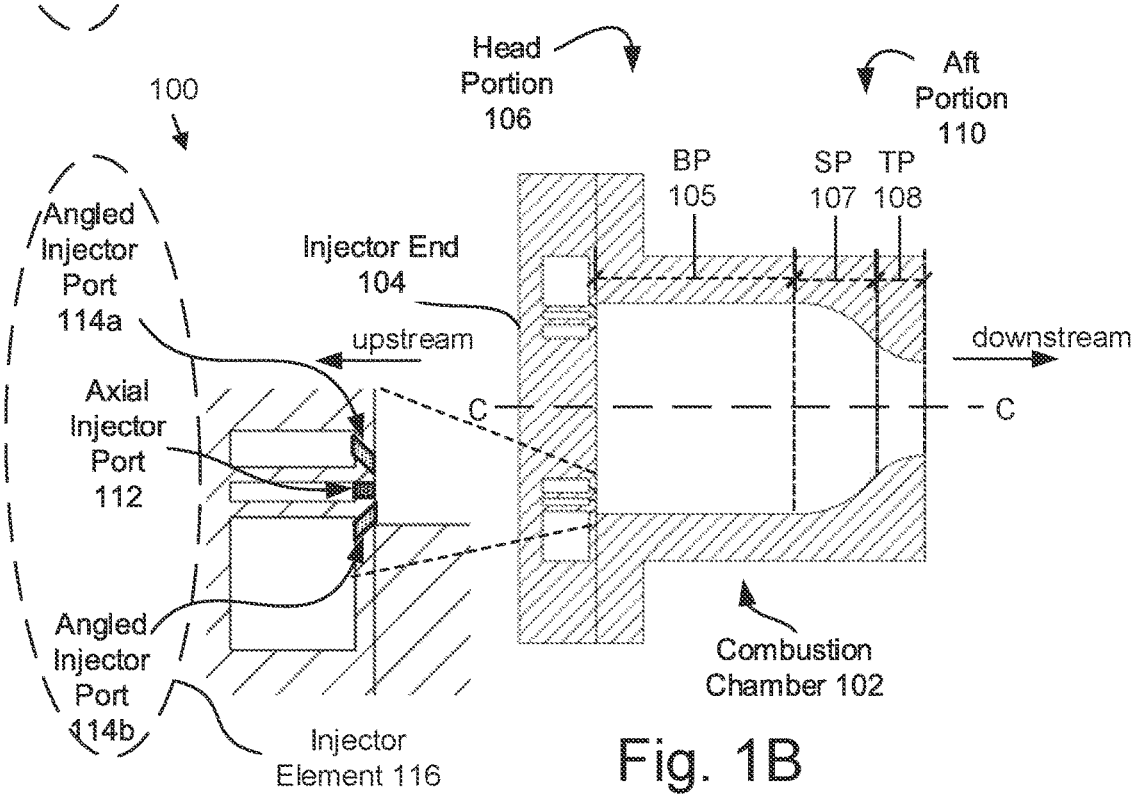
FIG. 1B is a cross-sectional view of the first implementation of the apparatus of FIG. 1A, according to one or more examples of the present disclosure.

FIG. 1A is a perspective view of a first implementation of an apparatus having a flowpath for optimizing acoustic wave confinement to increase combustion efficiency in a chamber having a converging geometry and axial injection, according to one or more examples of the present disclosure. FIG. 1B is a cross-sectional view of the first implementation of the apparatus of FIG. 1A, according to one or more examples of the present disclosure. In one embodiment, the apparatus 100 includes a combustion chamber 102 having a cylindrical geometry configured to optimize acoustic wave confinement to combustion and injection regions at an injector end 104 (also sometimes referred to as an injector portion) at a head portion 106 of the combustion chamber 102 and a nozzle portion 108 (also sometimes referred to as a nozzle throat portion or a neck portion) at an aft portion 110 of the combustion chamber 102.

In various examples, the apparatus 100 locates injector elements 116 that may include perpendicular injector ports 112 and angled injector ports 114 along an outer portion of the combustion chamber 102. FIG. 1B is a cross-sectional view of the first implementation of the apparatus of FIG. 1A where the injector elements 116 are placed along an outer portion of the combustion chamber and may each include one or more perpendicular injector ports 112, as well as one or more angled injector ports 114.

Figure 1C:
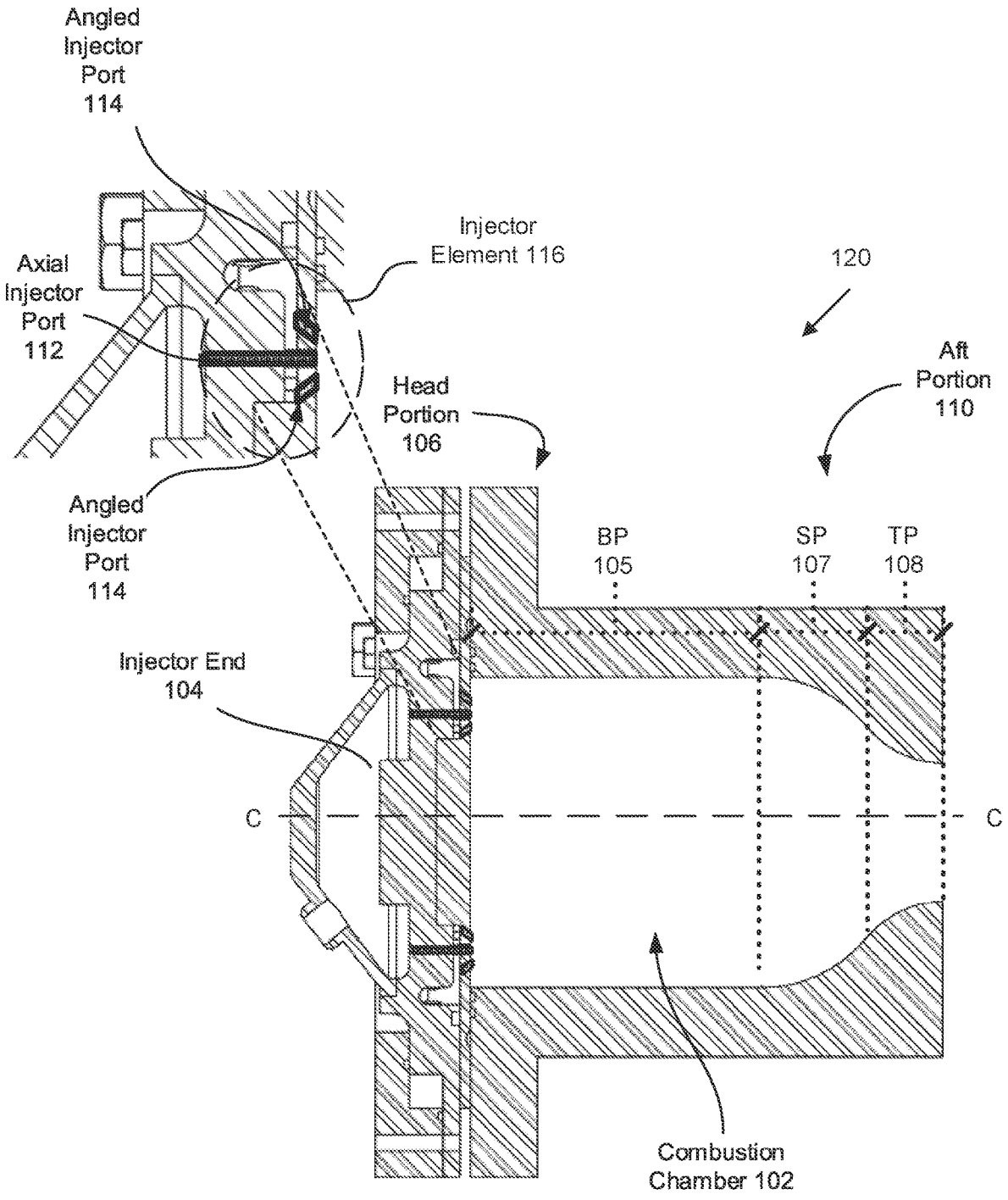
FIG. 1C is a cross-sectional view of a second implementation of an apparatus for optimizing acoustic wave confinement to increase combustion efficiency in a chamber having a generally bottle-shaped converging geometry and axial injection, according to one or more examples of the present disclosure.

In various examples, the combustion chamber 102 is a cylindrical chamber designed to enable efficient combustion along an outer ring. In some examples, the cylindrical geometry at the head portion 106 of the combustion chamber 102 confines tangential modes of acoustic waves to the injection and combustion region at the head portion 106 which increase both local mixing and unsteady pressure thereby increasing combustion efficiency. In various examples, the head portion 106 includes a body portion (BP) 105 as depicted in FIGS. 1B and 1C. For example, in some examples, the BP 105 of the combustion chamber 102 may be generally cylindrical at the head portion 106 and may converge at the aft portion 110 which in certain examples includes a shoulder portion 107 (SP), with a radius, polynomial or other curves as depicted in various the Figures disclosed herein.

In some examples, the apparatus 100 includes a single nozzle that couples to the nozzle throat portion 108 (TP) also sometimes referred to as a throat portion or a nozzle portion of the combustion chamber 102. In other examples, the apparatus 100 includes multiple nozzles that couple to the nozzle portion 108 at the aft portion 110 of the combustion chamber 102. In certain examples, the apparatus 100 does not include any nozzles. Although the apparatuses 100, 120, 200, 220, 300, 400, 420, 440 depicted respectively in FIGS. 1A-4C only show a converging nozzle portion 208, in some examples, the chamber geometries do not need to fully choke at the output. Accordingly, in various examples, differences in the number of nozzles used may depend on the application. For instance, furnaces for heating or other industrial uses may not require a nozzle, while "divert and attitude control systems" (DACS) such as used in some rockets may use multiple nozzles to provide thrust control. Thus, various applications with zero, one, or multiple nozzles may similarly benefit from pressure gain combustion and/or improved mixing provided by the wave-optimizing chamber geometries disclosed herein.

In various examples, the injector end 104 includes multiple injector elements 116 located around an outer portion of the combustion chamber 102. Each injector element 116 may include one or more perpendicular injector ports 112, angled injector ports 114, or various combinations of both. For example, the apparatuses 100, 120, 200, 220, 300, 400, 420, 440 depicted respectively in FIGS. 1A-4C show a triplet which is one configuration of an injector element 116 just as a doublet, pentad, swirl coaxial injector are other configurations of an injector element 116. A triplet whose propellant stream is oriented axially may be referred to as an axial injector element. Conversely, a swirl coaxial injector oriented radially may be referred to as a radial injector element.

In one embodiment, the injector element 116 is an axial injector element and comprises a triplet of a perpendicular injector port 112 and two angled injector ports 114 is used. In some examples, the perpendicular injector element 112 is configured to inject fuel and the angled injector ports 114 is configured to inject oxidizer. It may be noted that although various figures, such as FIG. 1A and FIG. 1B, depict the injector elements 116 as triplets, such examples are merely illustrative and other injector element configurations may be implemented. For example, in some examples, injector elements 116 may include doublets, coaxial configurations, triplets, split triplets, pentads, or any other selected injector elements 116 that assists to provide efficient mixing of fuel and oxidizer.

In certain examples, the perpendicular injector ports 112 and the angled injector ports may be configured to provide overlapping propellant streams. For example, FIG. 5B, which is described in more detail below, depicts one example illustrating how adjacent triplet injector elements can be configured to provide overlapping propellant streams. In various examples, the combustion chamber 102 may include a centerbody device to limit crosswise wave interference and/or to direct the outlet flow. For example, in some examples, the combustion chamber 102 includes a single centerline resonator cavity for limiting longitudinal acoustic wave modes. The term centerline refers to a longitudinal centerline depicted as C-C in various Figures as explained in more detail below. In some examples, the combustion chamber 102 includes multiple resonator cavities on the headwall at the injector end 104.

In some examples, the apparatus 100 optimizes acoustic wave confinement thus taking advantage of an acoustic instability to improve combustion efficiency over existing deflagrating engines. In certain examples, e.g., as an upper limit, the optimized acoustic wave may transition to a detonation. In this mode of operation, apparatuses 100, 120, 200, 220, 300, 400, 420, 440 depicted respectively in FIGS. 1A-4C are configured to operate equivalently to a detonation engine, such as for example a rotating detonation engine or a pulse detonation engine without necessarily requiring the complexities of rotating detonation engines or pulse detonation engines.

In various examples, a variety of propellants may be used. Some suitable propellants include for example gaseous propellants, liquid propellants, solid propellants, hybrid propellants, and or gel propellants. Thus, for example, in certain examples, the oxidizer is injected, and the fuel is solid. For example, in some examples, the solid propellant grain or chamber geometries are configured e.g. shaped in such a way that the acoustic modes are isolated to the combustion zone, e.g., nearer to the injector end 104.

In certain examples, the injector elements 116 are arranged as one or more rings along an outer portion of the injector end 104 radius, thus providing improved acoustic coupling over injection not confined to the outer portion of the radius of the combustion chamber 102. Additional details regarding the placement of the injector elements along an outer portion of the injector end 104 are provided with respect to FIG. 5A below. As compared to combustion apparatuses and methods that focus primarily on improving stability, for example, by canting injector elements to inject at one or more predetermined angles towards the outer wall of the combustion chamber, the examples described herein may be used with injector elements having various injection angles.

Although the apparatus 100 may improve efficiency and performance of combustion devices, such as for example, liquid-liquid injected rocket engines, it may also be used to improve efficiency and performance of combustion devices such as air-breathing engines, gas generators, pre-burners, and/or power generators.

Thus, the apparatus 100 improves combustion chamber technology by purposefully utilizing combustion instability to improve efficiency and performance. For example, in certain examples, axial injection is a practical configuration for apparatuses with a cylindrical combustion chamber such as the apparatuses 100, 120 depicted in FIGS. 1A-1C and radial injection is a practical configuration for apparatuses with a converging combustion chamber such as the apparatuses 200, 300, 400, 420, and 440, depicted respectively in 2A-4C. Unless otherwise clear from context, the term "axial injection refers to injection in which the flow of the propellants prior to combustion is generally downstream toward the combustion chamber exit. Similarly, the term "radial injection refers to injection in which the flow of the propellants prior to combustion is generally radially inward toward a longitudinal centerline C-C, where the longitudinal centerline C-C is depicted in FIGS. 1B, 1C, 2B, 2C, 3. Similar imaginary centerlines exist in various examples depicted in other figures of this application.

FIG. 1C is a cross-sectional view of a second implementation of an apparatus for optimizing acoustic wave confinement to increase combustion efficiency in a chamber having a converging geometry and axial injection, according to one or more examples of the present disclosure. Although the apparatus 120 is depicted as having some differences at the injector end 104 at the head portion 106 of the combustion chamber 102, the cylindrical geometry of the combustion chamber 102 similarly optimizes acoustic wave confinement to increase combustion efficiency as described above with respect to the apparatus 100 depicted in FIGS. 1A and 1B.

Figure 2A:
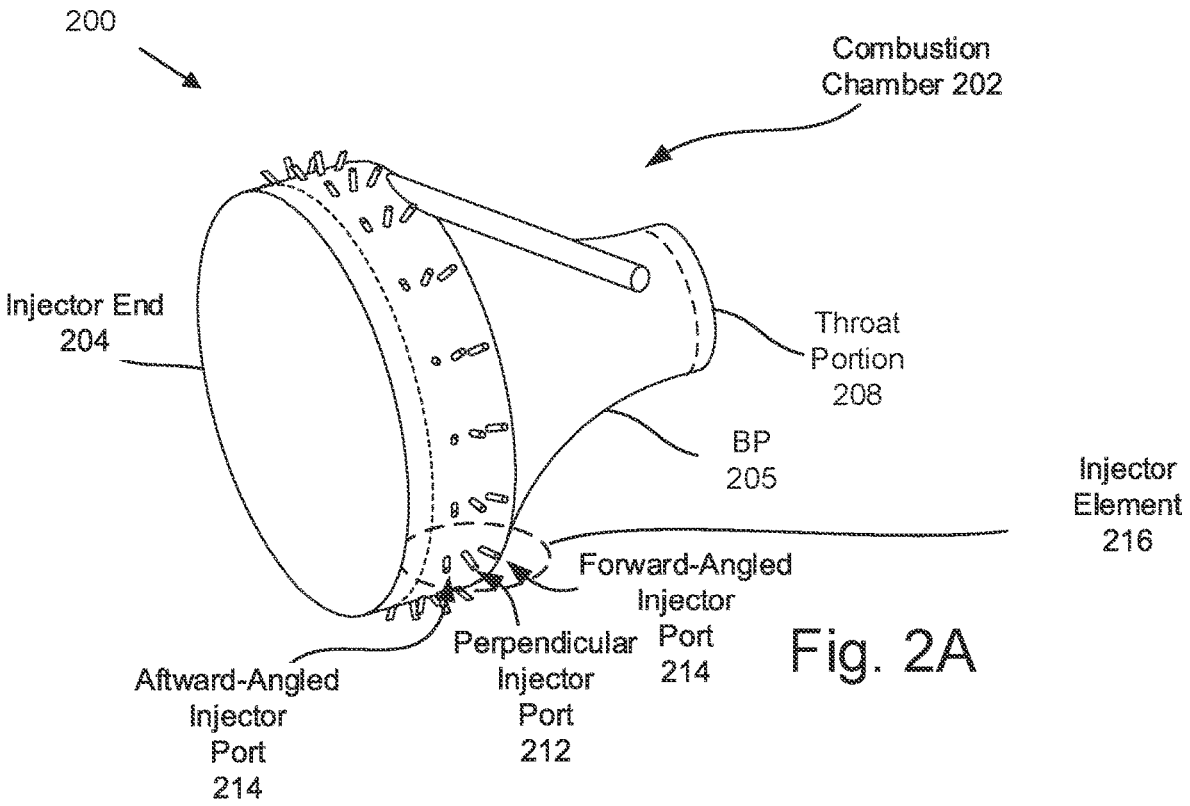
FIG. 2A is a perspective view of a third implementation of an apparatus for optimizing acoustic wave confinement to increase combustion efficiency in a chamber having a generally campanulate-shaped converging geometry and generally radial injection, according to one or more examples of the present disclosure.
Figure 2B:
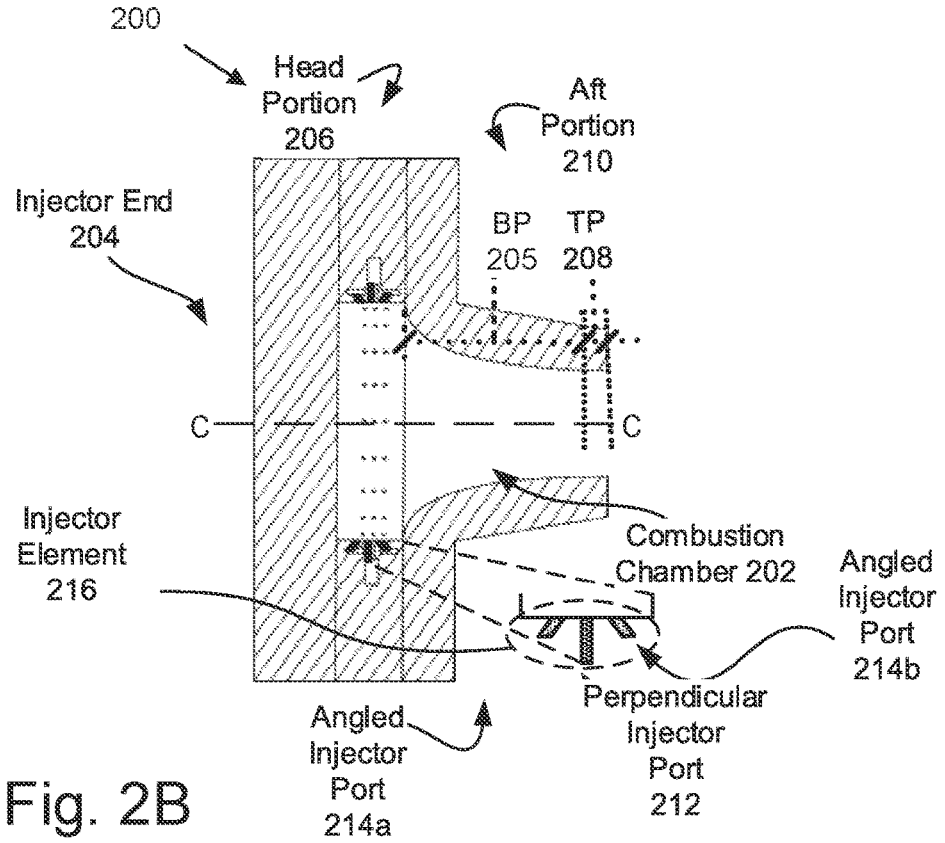
FIG. 2B is a cross-sectional view of the third implementation of the apparatus of FIG. 2A, according to one or more examples of the present disclosure.

FIG. 2A is a perspective view of a third implementation of an apparatus for optimizing acoustic wave confinement to increase combustion efficiency in a chamber having a converging geometry and radial injection, according to one or more examples of the present disclosure. FIG. 2B is a cross-sectional view of the third implementation of the apparatus of FIG. 2A, according to one or more examples of the present disclosure.

In various examples, the geometry of the combustion chamber 202 is converging, in some examples, the geometry of the combustion chamber 202 converges linearly towards the aft portion 210. In other examples, the geometry of the combustion chamber 202 has a body portion (BP) 205 that is substantially campanulate and converges towards a nozzle throat portion 208 at the aft portion 210 with a decreasing radius that follows a polynomial, or other types of curve. Unless otherwise clear from context, in various examples, the inner walls of the combustion chamber are smooth meaning that the inner walls of the body portion, the shoulder portion, and the nozzle throat portion are substantially solid and undisturbed by inclusion of bumps, holes, ports, roughness, and similar elements, except where a portion of the combustion chamber is disposed upstream of an exaggerated radial injector such as depicted in FIG. 4C or where one or more resonators are configured to damp acoustic waves having predetermined wavelengths.

In certain examples, the radial injection of the apparatus 200 reinforces the confinement and/or colocation of the combustion with the tangential acoustic modes and thus provides improvements in efficiency by mixing in a way that enhances pressure gain combustion at the head portion 206 of the combustion chamber 202. As noted above, in certain examples, a radial injection may be particularly well-suited for a combustion chamber having a converging geometry and axial injection may be particularly well-suited for a combustion chamber having a cylindrical geometry. Nevertheless, in some examples, radial injection and/or axial injection may be used with either cylindrical or converging combustion chamber geometries that optimize the acoustic modes and mixing to occur near the head portion 106, 206, where the injection and combustion occurs.

In various examples, the number of perpendicular injector ports 212 and angled injector ports 214*a*, 214*b* in each injector element 216, may vary similarly to the various configuration alternatives for the perpendicular injector ports 112 and angled injector ports 114 described above with respect to the injector elements 116 depicted in FIGS. 1A-1C. Similarly, operation of the apparatus 200 may be done with or without detonations and using various types of propellants as described above with respect to FIGS. 1A-1C.

Furthermore, the placement of the injector elements 216 along an outer portion of the radius of the converging combustion chamber 202 may improve efficiency as explained below with respect to FIG. 5A.

Figure 2C:
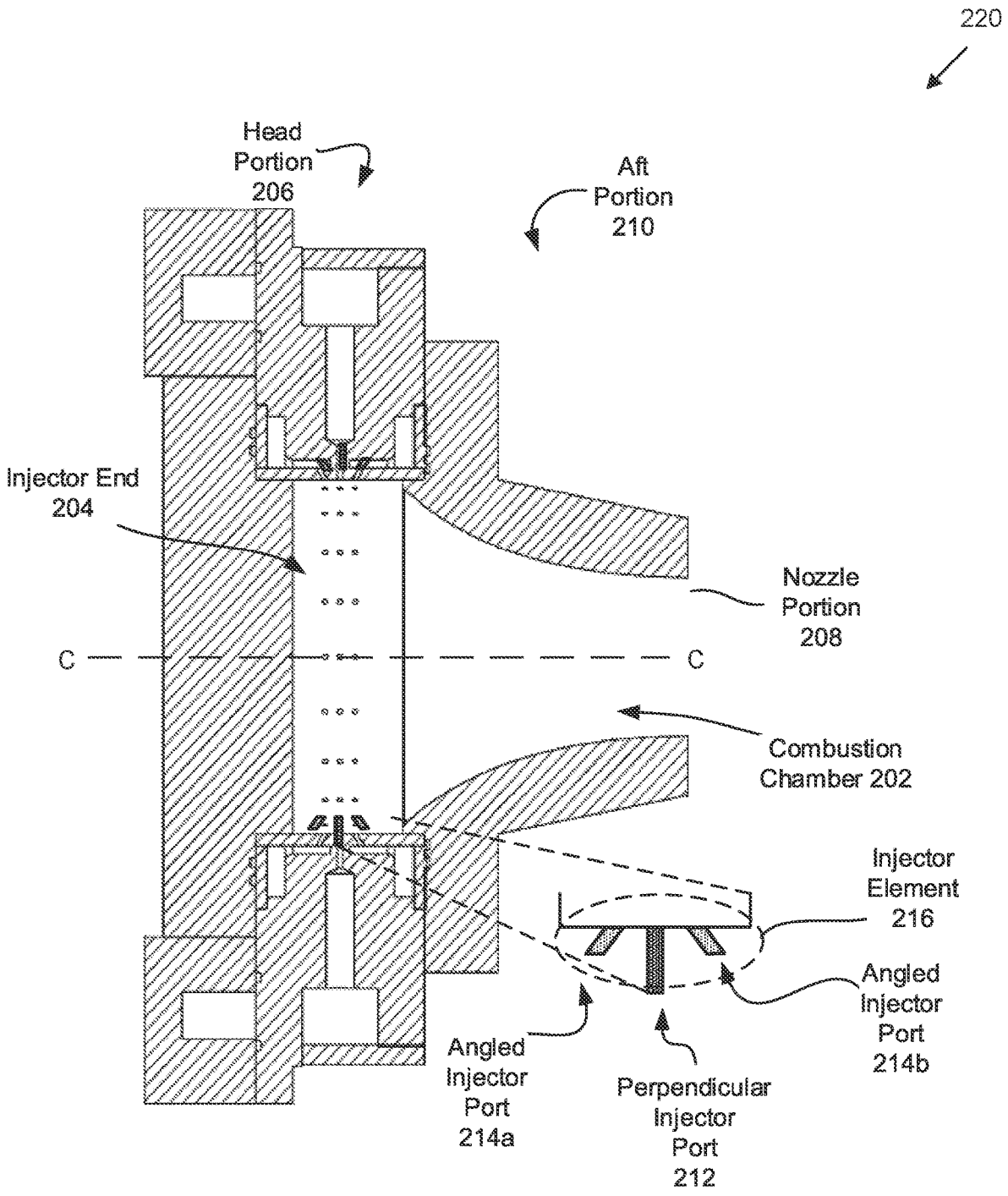
FIG. 2C is a cross-sectional view of a fourth implementation of an apparatus for optimizing acoustic wave confinement to increase combustion efficiency in a chamber having a converging geometry and radial injection, according to one or more examples of the present disclosure.

FIG. 2C is a cross-sectional view of a fourth implementation of an apparatus 220 for increasing combustion efficiency with radial injection. In certain examples, the apparatus 220 depicted in FIG. 2C is substantially similar to the apparatus 200 depicted in FIGS. 2A and 2B. Accordingly, the various parameters and options described above with respect to FIGS. 2A and 2B may be similarly implemented in the apparatus 220 depicted in FIG. 2C.

Figure 3:
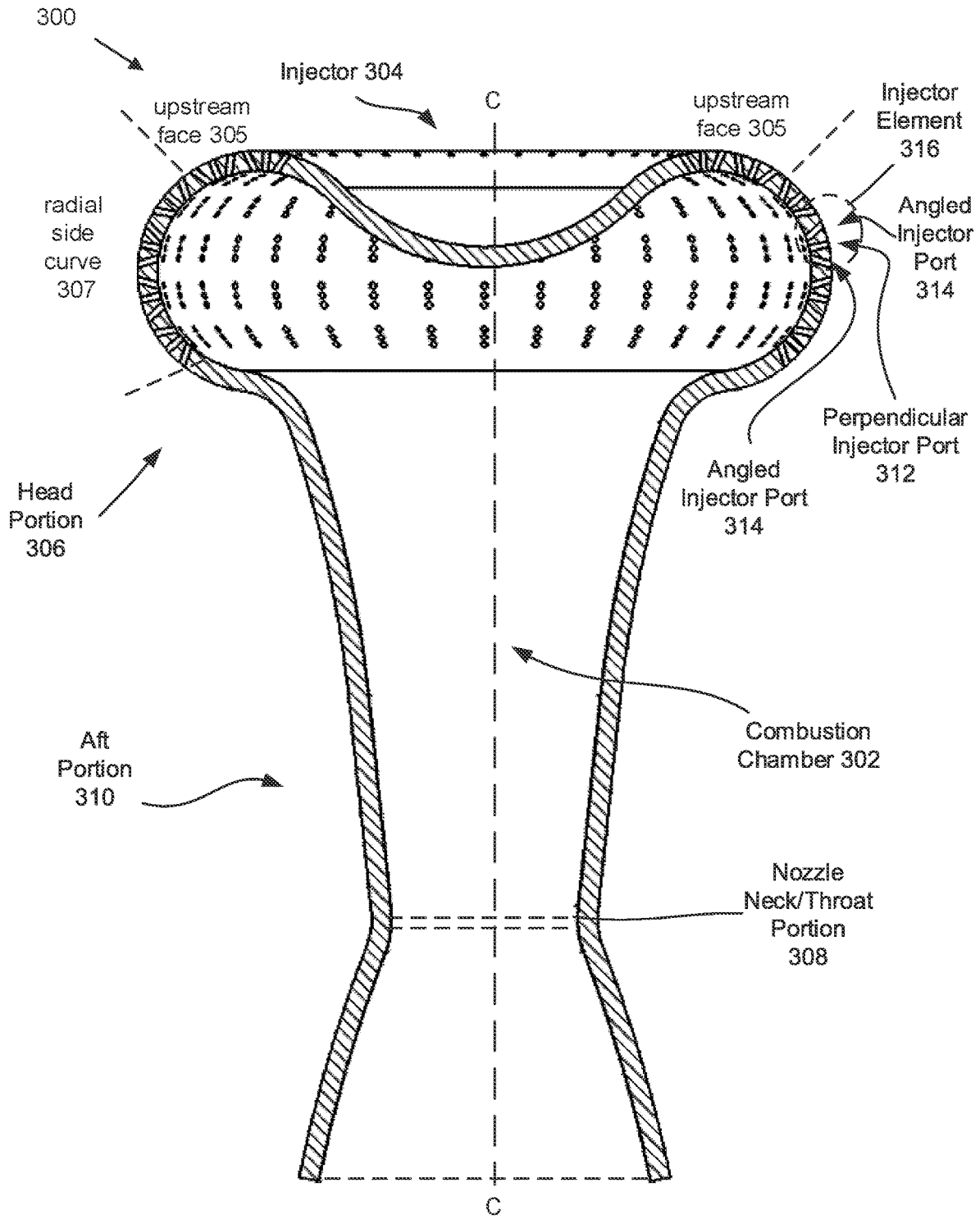
FIG. 3 is a cross-sectional view of a fifth implementation of an apparatus for optimizing acoustic wave confinement to increase combustion efficiency in a chamber having a toroidal geometry with radial injection at the head portion where the chamber geometry converges near an aft portion, according to one or more examples of the present disclosure.

FIG. 3 is a cross-sectional view of a fifth implementation of an apparatus 200 for optimizing acoustic wave confinement to increase combustion efficiency in a chamber having an injector 304 with a semi-toroidal geometry that uses a combination of radial injection and axial injection to increase local mixing and unsteady pressure at the head portion. As use herein, the term "semi-toroidal" mean that at least a portion of the geometry has a toroidal shape. For example, the upstream portion of injector 304 may be substantially toroidal whereas the downstream portion of the injector 304 may be less toroidal than the upstream portion.

In some examples, the injector 304 includes a first set of injector elements 316 distributed along one or more rings of an upstream face 305 of the semi-toroidal injector 304. Such injectors elements serve as generally axial injectors. In certain examples, another set of injector elements 316 is distributed along a radial side curve of the semi-toroidal injector 304. These injectors elements 307 are configured to serve as generally radial injectors. In one example, the injector 304 include four rings of injector elements 316 distributed along the radial side curve 307 and two rings of injector elements 316 distributed along the upstream face 305 of the injector 304.

Although the injector elements 316 are depicted as triplets, split triplets, doublet, pentads, and the like may be used.

A body portion 305 of the combustion chamber 302 has a generally campanulate shape that converges near a nozzle throat portion 308 at the aft portion 310, according to one or more examples of the present disclosure. The apparatus 300 includes substantially similar components, functions, and options to those described above with respect to the apparatuses 200, and 220 described above and depicted in FIGS. 2A, 2B, and 2C. In various examples, the injector end 304 is configured to have a semi-toroidal shape which further isolates the tangential acoustic mode to the injector face. The combination of axial and radial injection creates impinging propellant streams which aid in collocating the combustion with the acoustic mode and improves the efficiency of mixing and facilitates pressure gain combustion.

Figure 4A:
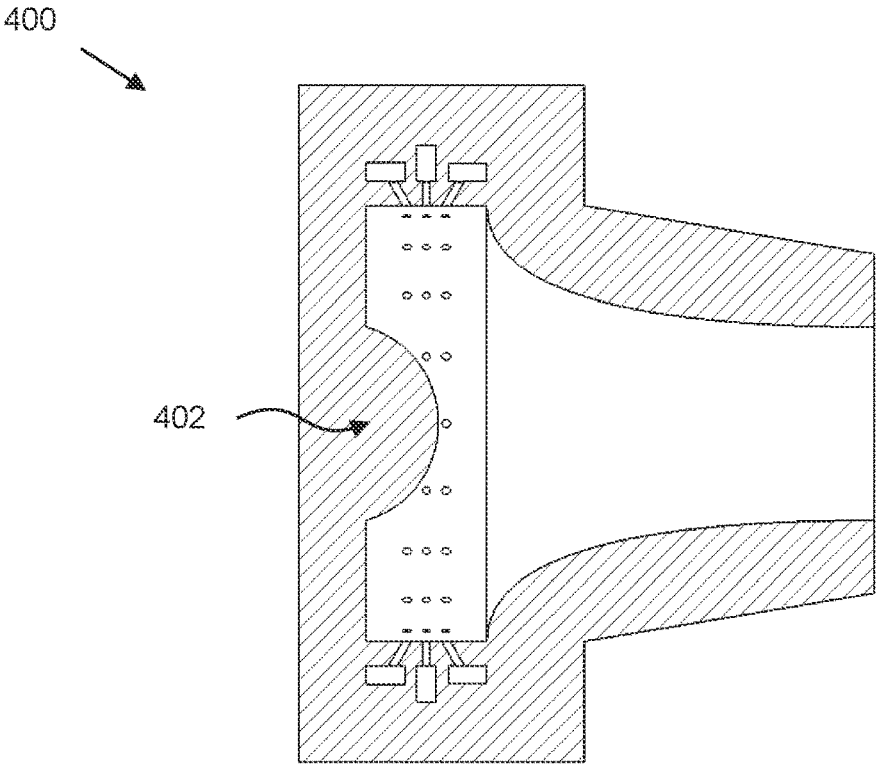
FIG. 4A is a cross-sectional view of a sixth implementation of an apparatus for optimizing acoustic wave confinement to increase combustion efficiency in a chamber having radial injection and a curved injector headwall and a chamber geometry that converges toward the aft portion, according to one or more examples of the present disclosure.

FIG. 4A is a cross-sectional view of a sixth implementation of an apparatus 400 for increasing combustion efficiency with radial injection and a centerbody device 402 that is curved. In certain examples, the centerbody device 402 is a upstream facing concavity that from the perspective of the radial injector elements acts as a downstream facing bump or a partially spherical projection that confines acoustic energy, e.g., acoustic waves into an outer annulus of blocks shock waves from traversing the chamber radially and guide flows downstream towards the nozzle.

Figure 4B:
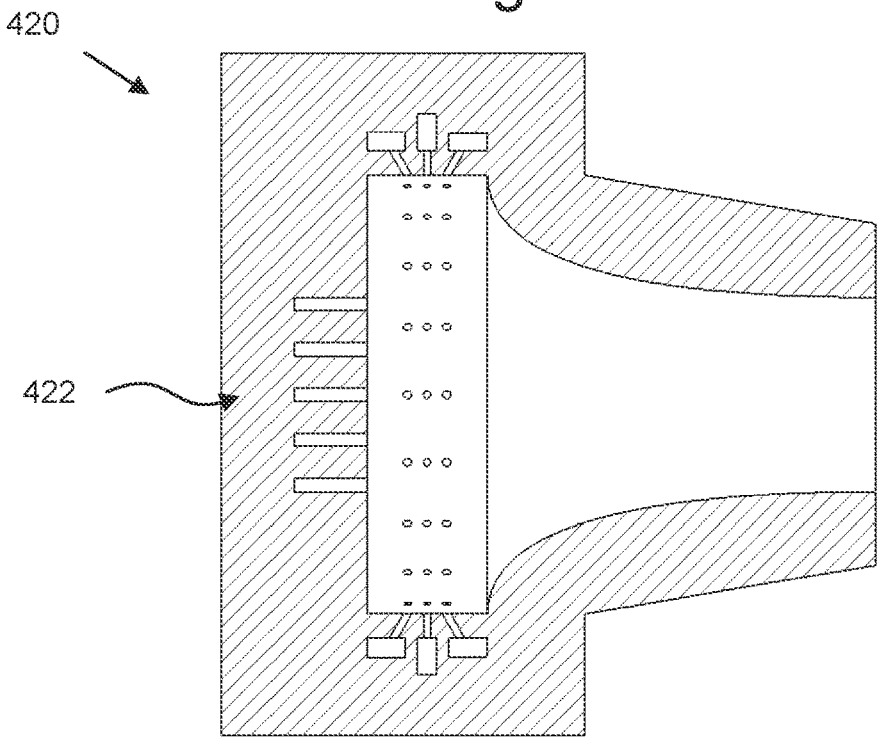
FIG. 4B is a cross-sectional view of a seventh implementation of an apparatus for optimizing acoustic wave confinement to increase combustion efficiency in a chamber having radial injection and axial resonator ports at the head portion and a chamber geometry that converges toward the aft portion according to one or more examples of the present disclosure.
Figure 4C:
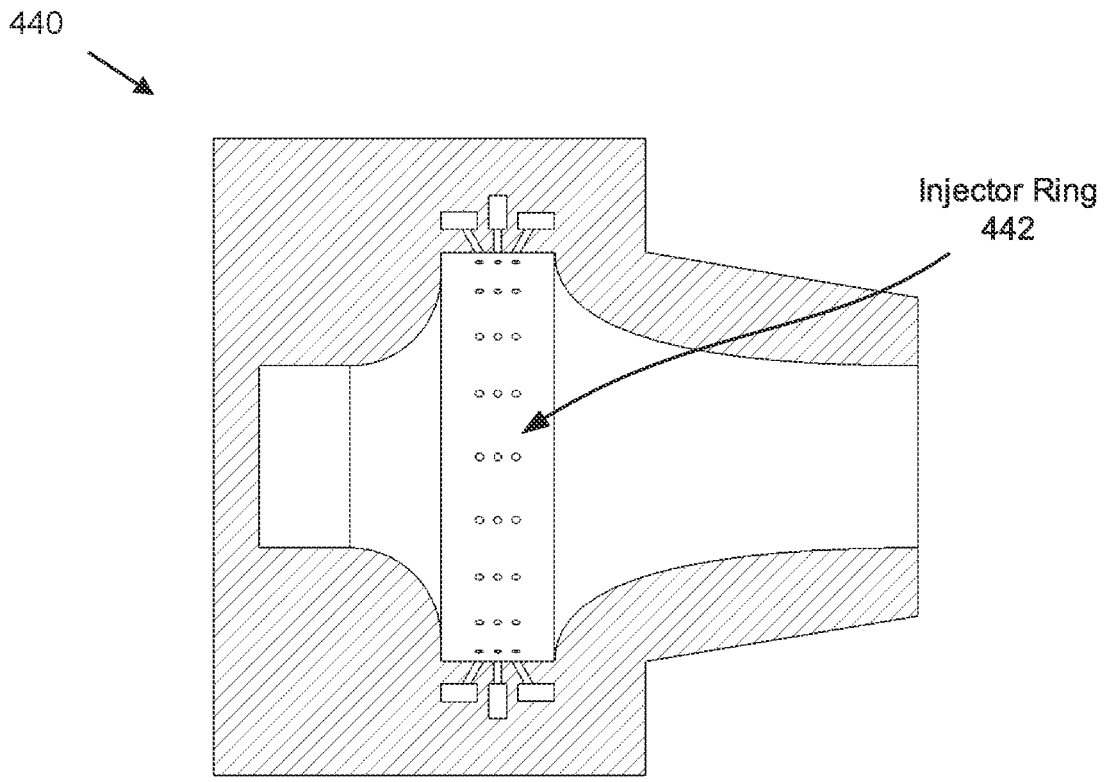
FIG. 4C is a cross-sectional view of an eighth implementation of an apparatus for optimizing acoustic wave confinement to increase combustion efficiency in a chamber having a converging geometry with an exaggerated radial injector ring to confine combustion and injection to the tangential acoustic wave and to reduce interaction with longitudinal modes, according to one or more examples of the present disclosure.

FIG. 4B is a cross-sectional view of a seventh implementation of an apparatus for optimizing acoustic wave confinement to increase combustion efficiency in a chamber having radial injection and axial resonator ports 422 at the head portion and a chamber geometry that converges toward the aft portion according to one or more examples of the present disclosure. In various examples, one or more centerbody devices (e.g., resonators) aid in confining acoustic energy into the outer annulus. In such examples, various centerbody devices, such as for example, the centerbody devices 402, block shock waves from traversing the chamber radially and guide flow towards the nozzle, thus further improving combustion efficiency.

FIG. 4C is a cross-sectional view of an eighth implementation of an apparatus 440 for increasing combustion efficiency with an exaggerated radial injector ring 442 to drive combustion upstream. In various examples, axial resonators and/or axial voids are configured to dampen unwanted unsteady modes, such as longitudinal waves, so as to limit the device's operation to the wanted tangential acoustic and/or shock waves. For example, as depicted in FIG. 4A, implementation of the chamber center body e.g., the curved portion of the apparatus 400 is configured to focus/confine the wave to the injection and combustion region, as well as to limit shock waves traveling directly across the chamber and interfering with the other sides injection and combustion and unsteady wave (limiting destructive interference). By driving the combustion upstream, the tangential acoustic wave modes are confined further toward the upstream injection and combustion regions thus improving the efficiency and performance of the apparatus 440 as compared with deflagrating constant pressure combustion devices.

Figure 5A:
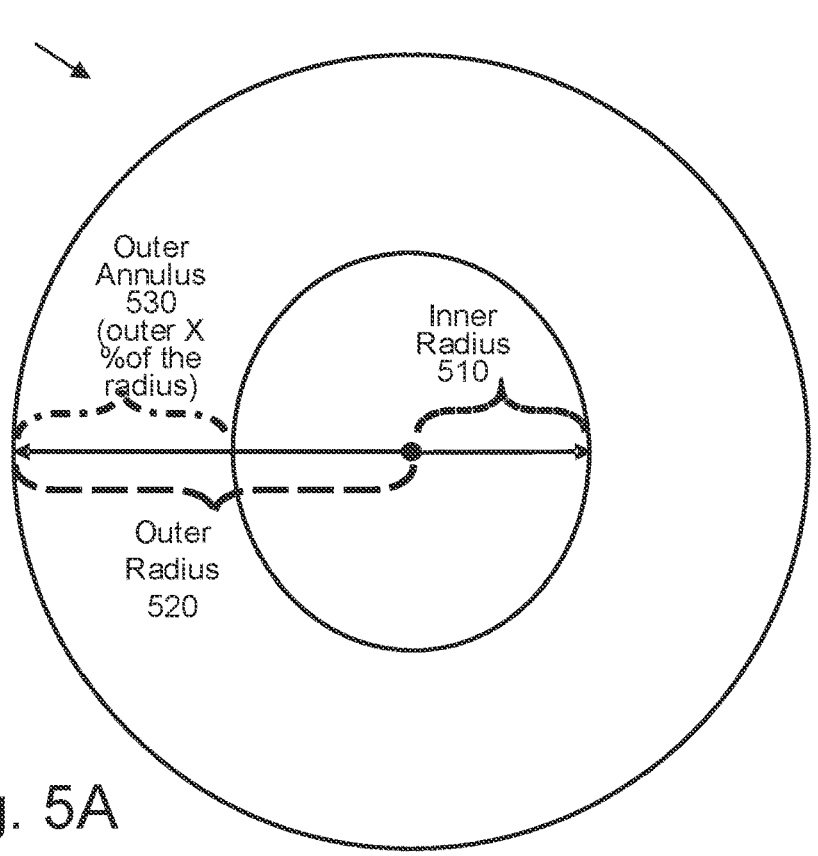
FIGS. 5A, 5B are axial views illustrating configuring injector placement to provide a predetermined percentage of mass flow within a predetermined outer radius percentage of an injector end radius for an apparatus for pressure gain combustion, according to one or more examples of the present disclosure.
Figure 5B:
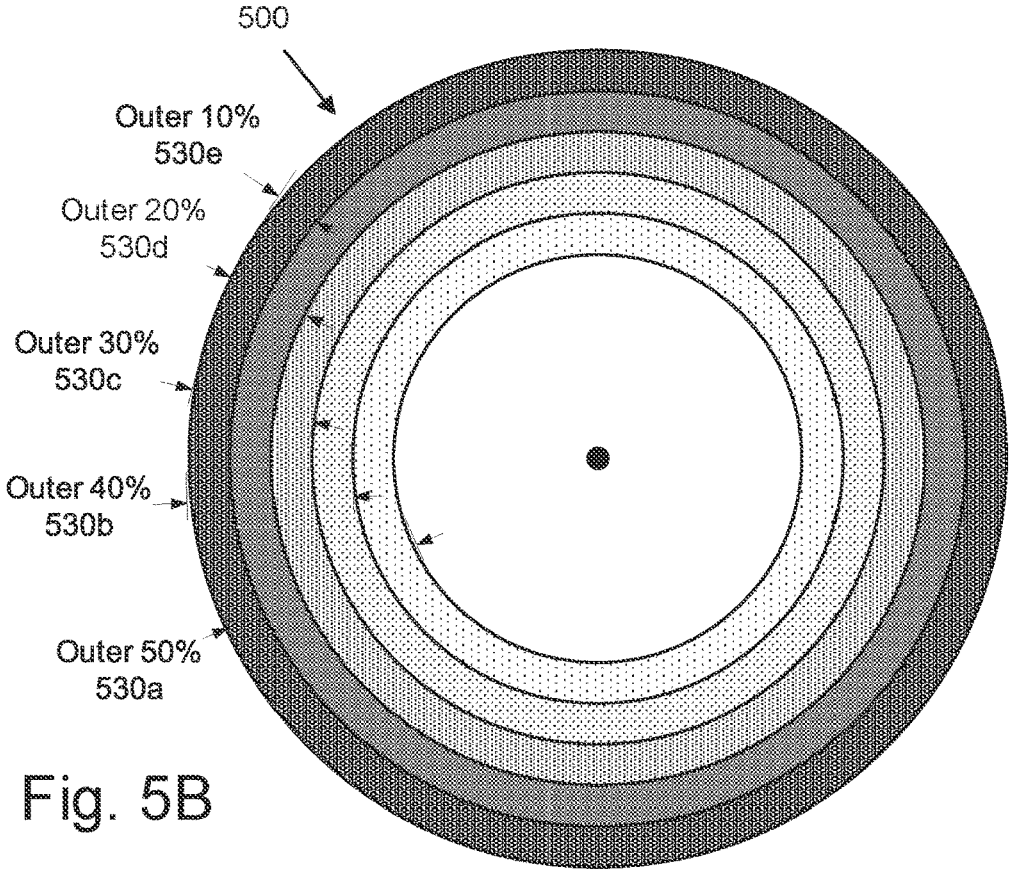

FIGS. 5A, 5B are axial views illustrating a radial cross section 500 of a combustion chamber in accordance with one or more examples of the disclosure. configuring injector placement to provide a predetermined percentage of mass flow within a predetermined outer radius percentage of an injector end radius for an apparatus for pressure gain combustion, according to one or more examples of the present disclosure. in various examples, the injector placement provides flow within a predetermined outer annulus 530 (e.g., an outer radius percentage of an injector end radius for an apparatus such as the apparatuses 100, 120, 200, 220, 300, 400, 420, and 440, as depicted respectively in FIGS. 1A-4C for pressure gain combustion).

In some examples, the placement of the injector elements e.g., 116, 216, 316, 416 is such that greater than 75%, 80%, 90%, or up to 100% of the mass flow occurs in the outer annulus 530 which in such examples is the outer 50% 530*a* of the radius. These numbers are computed based on uniform mass flow over a circle with outer radius 520, then computing the percentage of mass flow in an outer annulus 530 where the annulus is defined as the cross-sectional area between the inner radius 510 and the outer radius 520 and represents a predetermined outer percentage of the radius. In other examples, greater than 64%, 70%, 80%, 90%, or up to 100% of the mass flow occurs in the outer 40% 530*b* of the radius. In certain examples, greater than 51%, 60%, 70%, 80%, 90%, or up to 100% of the mass flow occurs in the outer 30% 530*c* of the radius. In some examples, greater than 36%, 40%, 50%, 60%, 70%, 80%, 90%, or up to 100% of the mass flow in the outer 20% 530*d* of the radius. In further examples, greater than 19%, 30%, 40%, 50%, 60%, 70%, 80%, 90%, or up to 100% of the mass flow occurs in the outer 10% 530*e* of the radius.

It may be noted that in various examples certain improvements in efficiency correspond to a greater percentage of mass flow that occurs in an outer annulus 530 that is a smaller percentage of the radius.

Figure 5C:
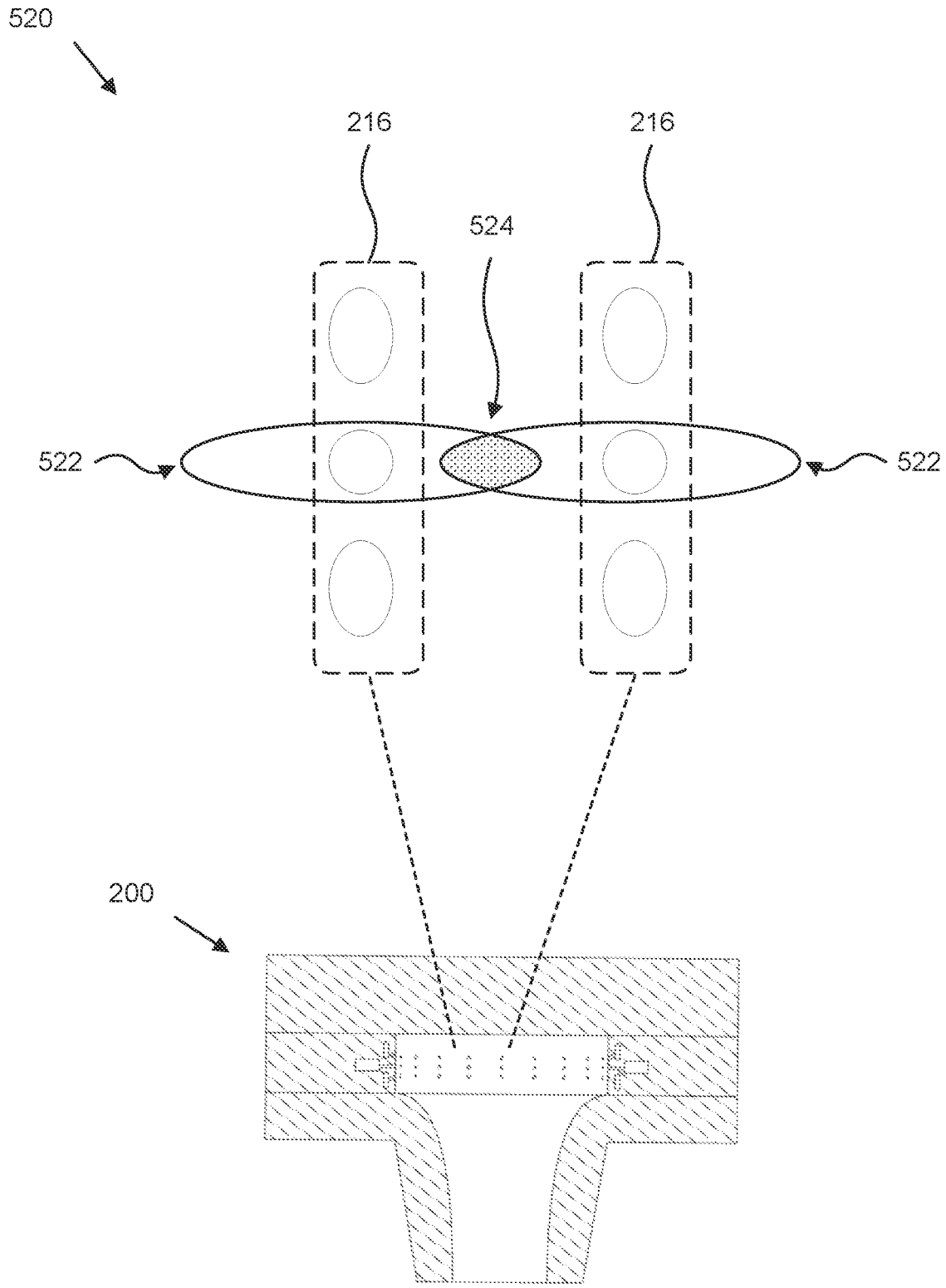
FIG. 5C is an illustration of configuring injector element spacing to provide overlapping ranges of propellant spray, according to one or more examples of the present disclosure.

FIG. 5C is an illustration of configuring the spacing of injector elements to provide overlapping propellant streams. For example, in various examples, the injector elements 216 described above with respect to the apparatus 200 depicted in FIGS. 2A-2C, may be spaced to provide overlapping propellant streams 522 with the overlapping portion 524 depicted between the injector elements 216. For other types of injector elements, e.g., doublets, coaxial, and so forth, the propellant streams 522 and the overlapping portion 524 correspond to the type of injector elements. In various examples, the overlapping propellant streams 522 may further improve mixing and or combustion efficiency.

Figure 6:
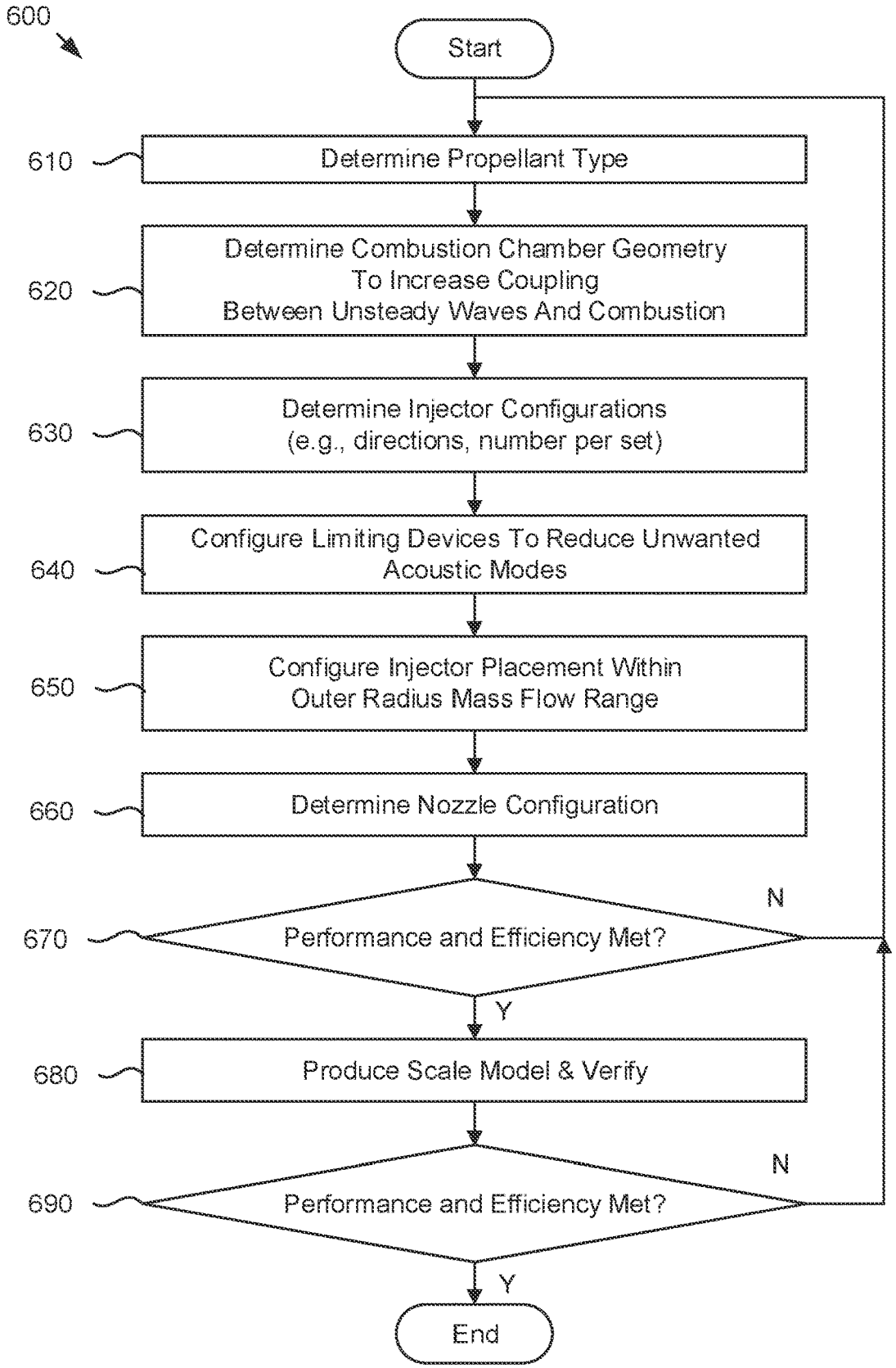
FIG. 6 is a schematic flowchart diagram of one implementation of a method of scaled-model design of an apparatus for pressure gain combustion, according to one or more examples of the present disclosure.

FIG. 6 is a schematic flowchart diagram of one implementation of a method 600 of scaled-model design of an apparatus for pressure gain combustion.

In one embodiment, the method 600 begins and determines 610 a propellant type, such as for example, gaseous propellants, liquid propellants, solid propellants, hybrid propellants, and/or gel propellants. The type of propellant selected may influence further steps in the method 600.

The method 600 continues and determines a combustion chamber geometry suitable to increase coupling between acoustic modes and combustion. In other words, the method 600 determines 620 a chamber geometry that promotes the formation of high amplitude waves in a combustion chamber. The method 600 continues and determines 620 a combustion chamber geometry to increase coupling between unsteady acoustic waves and combustion. For example, the geometry of the combustion chambers 102 increases coupling between unsteady acoustic waves and combustion by having a substantially cylindrical body portion which is proximate to the driving mechanisms (e.g., combustion) near the impinging flows of propellants. Likewise the geometry of the converging inner wall of the combustion chamber 202 further increases coupling between unsteady acoustic waves and combustion by having a substantially campanulate shaped body portion which is proximate to the driving mechanisms (e.g., combustion) near the mass flows of propellants as they flow downstream toward the chamber exit.

In some examples, the method 600 continues and determines 630 injector configurations for the combustion chamber. For example, determining 630 the injector configurations may include determining the number and arrangement of injector elements, such as for example triplets, split triplets, coaxial arrangements, tablets, pentads, impinging, showerhead, and/or other selected other injector element groupings. Furthermore, determining 630 the injector configurations may further include determining the angle of convergence of axial injector elements, angle injector elements, and/or radial injector elements. In certain examples, there is an absence of axial injector elements at an inner radius of the chamber, e.g., the radius of the chamber inside the outer annulus.

In various examples, the method 600 continues and includes determining 640 acoustic mode limiting devices such as centrally located resonator cavities to eliminate undesired acoustic modes. For instance, axially positioned resonator cavities may be incorporated in certain examples, for example, to eliminate longitudinal modes. In certain examples, the method 600 continues and includes configuring 650 injector placement within an outer radius mass flow range as described above with respect to FIG. 5A. In some examples, the method 600 continues and includes determining 660 a nozzle configuration. In some examples, zero nozzles are included in other examples a single nozzle is included and in further examples, multiple nozzles are included.

In various examples, the method 600 continues and includes determining whether performance and efficiency thresholds are met. If not, the method 600 continues and may include any portion or all of the actions 610, 620, 630, 640, 650, 660 described above. If the performance and stability thresholds are met the method continues and includes producing 680 physical scale models and verifying performance. In some examples, a small-scale model may be built and tested first, followed by the implementation and verification of a full-scale model. The method 600 continues and includes determining 690 whether performance and stability objectives for the scale models are met. If not, the method 600 continues and may include any portion or all of the actions 610, 620, 630, 640, 650, 660, 670, 680 or the method 600 as described above. If the performance and stability objectives for the scale models are met, the method 600 ends.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In the above description, certain terms may be used such as "up," "down," "upper," "lower," "horizontal," "vertical," "left," "right," and the like. These terms are used, where applicable, to provide some clarity of description when dealing with relative relationships. But these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive unless expressly specified otherwise. The terms "a," "an," and "the" also refer to "one or more" unless expressly specified otherwise. Further, the term "plurality" can be defined as "at least two."

As used herein, the term "about" means that the numerical value is approximate and small variations would not significantly affect the practice of the disclosed embodiments. Where a numerical limitation is used, unless indicated otherwise by the context, "about" means the numerical value can vary by ±10% and remain within the scope of the disclosed examples.

As used herein, the term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other but having one or more additional elements between the coupled elements. Further, as used herein, securing one element to another element can include direct securing and indirect securing. Additionally, as used herein, "adjacent" does not necessarily denote contact. For example, one element can be adjacent to another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or a number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present subject matter may be embodied in other specific forms without departing from its spirit or essential characteristics. The described examples are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

an injector coupled to a head portion of a combustion chamber, the injector comprising a plurality of injector elements that are disposed forward of a body portion of the combustion chamber and away from an inner annulus and that inject into an outer annulus at the head portion of the combustion chamber;

wherein a geometry of the combustion chamber comprises the body portion and a throat portion;

wherein the body portion of the combustion chamber converges radially inward towards the throat portion;

wherein the plurality of injector elements in combination with the geometry of the combustion chamber are configured to confine a predetermined percentage of mass flow associated with combustion to the outer annulus at the head portion of the combustion chamber; and wherein the injector has a semi-toroidal shape, a first portion of the plurality of injector elements is disposed along an upstream face of the semi-toroidal shape and serve as generally axial injectors, and a second portion of the plurality of injector elements is disposed along a radial side curve of the semi-toroidal shape.

2. The apparatus of claim 1, wherein a ratio of the length of the body portion along a longitudinal centerline axis to a length of the throat portion is at least 8:1.

3. The apparatus of claim 1, further comprising a centerbody disposed forward of the body portion and radially inward from the injector elements in the injector at the outer annulus at the head portion of the combustion chamber, the centerbody having a smooth geometry that limits crosswise acoustic wave interference and directs the mass flow associated with the combustion outward toward the outer annulus at the head portion of the combustion chamber.

4. The apparatus of claim 1, wherein the outer annulus at the head portion of the combustion chamber comprises the outer 50% of the radius from the longitudinal centerline to the inner wall of the head portion of the combustion chamber and wherein greater than 75% of the mass flow associated with the combustion is confined to the outer annulus at the head portion of the combustion chamber.

5. The apparatus of claim 1, wherein the outer annulus comprises the outer 40% of the radius from the longitudinal centerline to the inner wall of the head portion of the combustion chamber and wherein greater than 64% of the mass flow associated with the combustion is confined to the outer annulus at the head portion of the combustion chamber.

6. The apparatus of claim 1, wherein the outer annulus comprises the outer 30% of the radius from the longitudinal centerline to the inner wall of the head portion of the combustion chamber and wherein greater than 51% of the mass flow associated with the combustion is confined to the outer annulus at the head portion of the combustion chamber.

7. The apparatus of claim 1, wherein the outer annulus comprises the outer 20% of the radius from the longitudinal centerline to the inner wall of the head portion of the combustion chamber and wherein greater than 36% of the mass flow associated with the combustion is confined to the outer annulus at the head portion of the combustion chamber.

8. The apparatus of claim 1, wherein the outer annulus comprises the outer 10% of the radius from the longitudinal centerline to the inner wall of the head portion of the combustion chamber and wherein greater than 19% of the mass flow associated with the combustion is confined to the outer annulus.

9. The apparatus of claim 1, wherein the injector elements comprise one or more oxidizer injector ports and one or more fuel injector ports, configured to inject a plurality of propellants respectively comprising at least one oxidizer and at least one fuel.

10. The apparatus of claim 9, wherein the propellants have a form selected from a gaseous form, a liquid form, a gel form, and a hybrid form.

11. The apparatus of claim 9, wherein the injector elements are selected from doublet, coaxial, triplets, split triplets, pentads, and combinations thereof.

12. A system comprising:

an apparatus selected from a rocket engine, an air breathing combustion engine, a gas generator, a preburner, and a power generator;

wherein the apparatus comprises a combustion chamber having:

an injector coupled to a head portion of the combustion chamber, the injector comprising a plurality of injector elements disposed forward of a body portion of the combustion chamber, away from an inner annulus, and in a wall that defines an outer annulus at the head portion;

wherein a geometry of the combustion chamber comprises the body portion and a throat portion;

wherein the body portion of the combustion chamber converges radially inward towards the throat portion;

wherein the plurality of injector elements in combination with the geometry of the combustion chamber are configured to confine a predetermined percentage of mass flow associated with combustion to the outer annulus at the head portion of the combustion chamber; and wherein the injector has a semi-toroidal shape, a first portion of the plurality of injector elements is disposed along an upstream face of the semi-toroidal shape and serve as generally axial injectors, and a second portion of the plurality of injector elements is disposed along a radial side curve of the semi-toroidal shape.

13. The system of claim 12, further comprising one or more nozzles coupled to the throat portion of the combustion chamber.

14. An apparatus comprising:

an injector at a head portion of a combustion chamber, the injector comprising a plurality of injector elements that are disposed forward of a body portion and away from an inner annulus and that inject into an outer annulus at the head portion of the combustion chamber;

wherein a converging geometry of the combustion chamber comprises the body portion that is smooth and converges radially inward towards a throat portion;

a centerbody disposed forward of the body portion and radially inward from the injector elements at the head portion, the centerbody comprising a closed, smooth, curved projection that blocks shock waves from radially traversing the head portion of the chamber by extending partially into the outer annulus at the head portion of the chamber;

wherein the converging geometry of the combustion chamber, the centerbody disposed forward of the body portion, and the plurality of injector elements injecting into the outer annulus at the head portion, combine to confine acoustic modes to injection regions in the head portion of the combustion chamber.

15. The apparatus of claim 14, wherein a ratio of the length of the body portion along a longitudinal centerline axis to the length of the throat portion is at least 8:1.

16. The apparatus of claim 14, wherein the outer annulus at the head portion comprises the outer 50% of the radius from the longitudinal centerline to the inner wall of the head portion of the combustion chamber and wherein greater than 75% of the mass flow associated with the combustion is confined to the outer annulus at the head portion of the combustion chamber.

17. The apparatus of claim 14, wherein the injector elements comprise one or more oxidizer injector ports and one or more fuel injector ports, configured to inject a plurality of propellants respectively comprising at least one oxidizer and at least one fuel.

18. The apparatus of claim 17, wherein the propellants have a form selected from a gaseous form, a liquid form, a gel form, and a hybrid form.

19. The apparatus of claim 14, wherein the injector elements are selected from doublet, coaxial, triplets, split triplets, pentads, and combinations thereof.

* * * * *